US007128105B2

(12) United States Patent
Tribble et al.

(10) Patent No.: US 7,128,105 B2
(45) Date of Patent: Oct. 31, 2006

(54) DEVICE FOR RECONSTITUTING A DRUG VIAL AND TRANSFERRING THE CONTENTS TO A SYRINGE IN AN AUTOMATED MATTER

(75) Inventors: Dennis Tribble, Ormond Beach, FL (US); Wahid Khan, Lindenhurst, IL (US)

(73) Assignee: ForHealth Technologies, Inc., Daytona Beach, FL (US)

( * ) Notice: Subject to any disclaimer, the term of this patent is extended or adjusted under 35 U.S.C. 154(b) by 166 days.

(21) Appl. No.: 10/821,268

(22) Filed: Apr. 7, 2004

(65) Prior Publication Data

US 2005/0224137 A1 Oct. 13, 2005

(51) Int. Cl.
*B65B 1/04* (2006.01)

(52) U.S. Cl. ..... 141/319; 141/27; 141/198; 141/329; 604/416

(58) Field of Classification Search ..... 141/18, 141/25, 27, 192, 198, 250, 284, 319, 383, 141/386, 329, 330; 604/411–416; 73/863.81, 73/864.11

See application file for complete search history.

(56) References Cited

U.S. PATENT DOCUMENTS 2,880,723 A 4/1959 Adams
2,981,432 A 4/1961 Flood
3,527,017 A 9/1970 Taylor et al.
3,736,933 A 6/1973 Szabo
3,835,897 A 9/1974 Gess
3,865,236 A 2/1975 Rycroft
3,880,211 A 4/1975 Gess
4,535,820 A 8/1985 Raines
4,586,546 A * 5/1986 Mezei et al. ..... 141/2
4,624,148 A 11/1986 Averette
4,683,916 A 8/1987 Raines
4,854,355 A * 8/1989 Chazot et al. ..... 141/130
5,012,845 A 5/1991 Averette
5,125,748 A 6/1992 Bjornson et al.
5,256,154 A 10/1993 Liebert et al.
5,341,854 A 8/1994 Zezulka et al.
5,356,393 A 10/1994 Haber et al.
5,597,530 A 1/1997 Smith et al.
5,651,775 A 7/1997 Walker et al.
5,704,921 A 1/1998 Carilli
5,805,454 A 9/1998 Valerino (Continued)

OTHER PUBLICATIONS

U.S. Appl. No. 10/846,959, Wahid Khan.

(Continued)

*Primary Examiner*—Timothy L. Maust
(74) *Attorney, Agent, or Firm*—Darby & Darby

(57) ABSTRACT

An automated medication preparation system including reconstitution of medication and its delivery to a syringe. An automated fluid delivery device that is movable in at least one direction and is adapted to perform at least one of the following operations: receiving and discharging diluent in a prescribed amount to reconstitute the medication in a drug vial; and aspirating and discharging reconstituted medication from the vial into the syringe. Further including a transfer device that includes a first section for piercing a septum of the vial and a second section for releasably mating with the fluid delivery device. The transfer device can remain within the vial for multiple uses without the need to repierce the septum. The transfer device has a first channel for carrying diluent or reconstituted medication and a second channel in fluid communication with a vent formed as part of the transfer device to permit airflow into the vial.

28 Claims, 10 Drawing Sheets

U.S. PATENT DOCUMENTS

| | | | | |
|---|---|---|---|---|
| 5,899,889 | A | 5/1999 | Futagawa et al. | |
| 5,900,557 | A * | 5/1999 | Tanihata et al. | 73/863.01 |
| 5,911,252 | A | 6/1999 | Cassel | |
| 6,027,472 | A | 2/2000 | Kriesel et al. | |
| 6,048,086 | A | 4/2000 | Valerino | |
| 6,360,794 | B1 * | 3/2002 | Turner | 141/329 |
| 2002/0020459 | A1 | 2/2002 | Baldwin | |
| 2002/0198738 | A1 | 12/2002 | Osborne | |
| 2004/0088951 | A1 | 5/2004 | Baldwin | |

OTHER PUBLICATIONS

U.S. Appl. No. 10/426,910, Osborne et al. (related application).
U.S. Appl. No. 10/728,364, Osborne et al. (related application).
U.S. Appl. No. 10/728,363, Osborne et al. (related application).
U.S. Appl. No. 10/728,371, Osborne et al. (related application).
B. Braun Medical Inc., product descriptions from on-line catalog, 3 pages.

* cited by examiner

DEVICE FOR RECONSTITUTING A DRUG VIAL AND TRANSFERRING THE CONTENTS TO A SYRINGE IN AN AUTOMATED MATTER

TECHNICAL FIELD

The present invention relates generally to medical and pharmaceutical equipment, and more particularly, to a transfer device for use in reconstituting a drug vial and later delivering a prescribed unit dose of medication to an automated syringe preparation system.

BACKGROUND

Disposable syringes are in widespread use for a number of different types of applications. For example, syringes are used not only to withdraw a fluid (e.g., blood) from a patient but also to administer a medication to a patient. In the latter, a cap or the like is removed from the syringe and a unit dose of the medication is carefully measured and then injected or otherwise disposed within the syringe.

As technology advances, more and more sophisticated, automated systems are being developed for preparing and delivering medications by integrating a number of different stations, with one or more specific tasks being performed at each station. For example, one type of exemplary automated system operates as a syringe filling apparatus that receives user inputted information, such as the type of medication, the volume of the medication and any mixing instructions, etc. The system then uses this inputted information to disperse the correct medication into the syringe up to the inputted volume.

In some instances, the medication that is to be delivered to the patient includes more than one pharmaceutical substance. For example, the medication can be a mixture of several components, such as several pharmaceutical substances.

By automating the medication preparation process, increased production and efficiency are achieved as well as achieving an increase in patient safety since manual manipulation, a principal cause of microbial contamination, is avoided. This results in reduced production costs and also permits the system to operate over any time period of a given day with only limited operator intervention for manual inspection to ensure proper operation is being achieved. Such a system finds particular utility in settings, such as large hospitals, including a large number of doses of medications that must be prepared daily. Traditionally, these doses have been prepared manually in what is an exacting but tedious responsibility for a highly skilled staff. In order to be valuable, automated systems must maintain the exacting standards set by medical regulatory organizations, while at the same time simplifying the overall process and reducing the time necessary for preparing the medications.

Because syringes are used often as the carrier means for transporting and delivering the medication to the patient, it is advantageous for these automated systems to be tailored to accept syringes. However, the previous methods of dispersing the medication from the vial and into the syringe were very time consuming and labor intensive. More specifically, medications and the like are typically stored in a vial that is sealed with a safety cap or the like that protects a penetrable membrane. The material can then be added to or removed from the vial by penetrating the membrane with a needle. In conventional medication preparation, a trained person retrieves the correct vial from a storage cabinet or the like, confirms the contents and then removes the safety cap manually. This is typically done by simply popping the safety cap off with one's hands. Once the safety cap is removed, the trained person inspects the integrity of the membrane and cleans the membrane. An instrument, e.g., a needle, is then used to pierce the membrane and withdraw the medication contained in the vial. The withdrawn medication is then placed into a syringe to permit subsequent administration of the medication from the syringe.

FIG. 3 illustrates an exemplary conventional syringe 10 that includes a barrel 20 having an elongated body that defines a chamber that receives and holds a medication that is disposed at a later time. The barrel 20 has an open proximal end with a flange being formed thereat and it also includes an opposing distal end that has a barrel tip 22 that has a passageway formed therethrough. An outer surface of the barrel tip or luer 22 can include features to permit fastening with a cap or other type of enclosing member. For example, the luer can have threads that permit a tip cap to be securely and removably coupled to the barrel tip 22 or to permit some other type of fitting or connector to be attached thereto. As previously mentioned, the term "medication" refers to a medicinal preparation for administration to a patient and most often, the medication is contained within the chamber 30 in a liquid state even though the medication initially may have been in a solid state, which was processed into a liquid state.

The syringe 10 further includes a plunger 24 that is removably and adjustably disposed within the barrel 20. The plunger 24 can draw a fluid (e.g., air or a liquid) into the chamber by withdrawing the plunger 24 from an initial position where the stopper is near or at the barrel tip or luer 22 to a position where the stopper is near the proximal end of the barrel 20. Conversely, the plunger 24 can be used to expel or dispense medication by first withdrawing the plunger 24 to a predetermined location, filling the chamber with medication and then applying force against the flange so as to move the plunger 24 forward within the chamber. It will be appreciated that while a syringe is one type of device that can be used with the transfer device of the present invention for containing a dose of medication, there are a number of other types of devices that can equally be used. Therefore, the discussion of syringe 10 is meant to be only illustrative and not limiting in any manner.

Typically, a drug is provided of the shelf in solid form within an injectable drug vial that is initially stored in a drug cabinet or the like. To prepare an injectable unit dose of medication, a prescribed amount of diluent (water or some other liquid) is added to the vial to cause the solid drug to liquefy. Mixing and agitation of the vial contents is usually required. This can be a time consuming and labor intensive operation since first it must be determined how much diluent to add to achieve the desired concentration of medication and then this precise amount needs to be added and then the vial contents need to be mixed for a predetermined time period to ensure that all of the solid goes into solution. Thus, there is room for human error in that the incorrect amount of diluent may be added, thereby producing medication that has a concentration that is higher or lower than it should be. This can potentially place the patient at risk and furthermore, the reconstitution process can be very labor intensive since it can entail preparing a considerable number of medication syringes that all can have different medication formulations. This also can lead to confusion and possibly human error and also is an opportunity for microbial contamination when performed by hand.

If the medication needs to be reconstituted, the medication initially comes in a solid form and is contained in an injectable drug vial and then the proper amount of diluent is added and the vial is agitated to ensure that all of the solid goes into solution, thereby providing a medication having the desired concentration. The drug vial is typically stored in a drug cabinet or the like and is then delivered to other stations where it is processed to receive the diluent. As is known, the drug vial typically includes a pierceable septum that acts as a seal and prevents unwanted foreign matter from entering into the drug vial so as to contaminate the contents thereof as well as keeping the contents safely within the interior of the drug vial when the drug is stored or even during an application. The septum is typically formed of a rubber material that can be pierced by a sharp transfer device to permit communication with the interior of the drug vial and then when the transfer device is removed the small piercing hole seals itself due to the material properties of the septum. The sharp transfer device is typically a sharp tip of a cannula and over time, repeated piercing of the septum by the sharp cannula point can result in a breakdown of the integrity of the septum. In other words, repeated piercing of the septum can result in the septum losing some of its sealing properties and thus, leakage, etc. becomes possible when the drug vial is mishandled or inverted, as it can be during drug preparation and agitation operations.

What is needed in the art and has heretofore not been available is a system and method for automating the medication preparation process and more specifically, an automated apparatus for reconstituting and then delivering a prescribed amount of medication to a syringe or the like and one which overcomes the foregoing problems and which ensures that the connection between the cannula or the like and the drug vial remains robust over time.

SUMMARY

In one exemplary embodiment, an automated medication preparation system including automated syringe preparation that involves reconstitution of the medication is provided. The system includes: an automated device for delivering a prescribed dosage amount of medication to the syringe by delivering the medication through the uncapped barrel in a just-in-time for use manner; a controller in communication with the automated device and including a database for storing reconstitution information that is executable with the automated device for reconstituting the medication prior to it being injected into the syringe; and a transfer device that is constructed so that it can pierce a septum and remain disposed therein and is adapted to sealingly mate with a complementary fitting that is part of a device, such as a syringe or a tube to permit fluid to be withdrawn or delivered, respectively, to the drug vial.

In one exemplary embodiment, an automated medication preparation system is provided and is in the form of an automated syringe preparation that includes reconstitution of the medication and delivery of the reconstituted medication to a syringe. The system includes an automated device for delivering a prescribed dosage amount of medication to the syringe by injecting the medication through an uncapped barrel in a just-in-time for use manner. More specifically, one exemplary automated device for delivering a prescribed dosage amount of medication to the syringe is an automated device having a fluid delivery device that is movable in at least one direction, with the fluid delivery device being adapted to perform at least one of the following operations: (1) receiving and discharging diluent from a diluent supply in a prescribed amount to reconstitute the medication in a drug vial; and (2) aspirating and later discharging reconstituted medication from the drug vial into the syringe.

The system also includes a transfer device that includes a first section for piercing the septum of the drug vial and a second section for sealingly yet releasably mating with the fluid delivery device. The transfer device is constructed so that it remains within the drug vial for multiple uses without the need to pierce the septum more than one time and therefore, the disadvantages associated with the prior art are overcome. The transfer device has a first channel extending through the first and second sections for carrying diluent or reconstituted medication and a second channel that is in fluid communication with a vent that is formed as part of the transfer device to permit air to flow into the drug vial.

In one embodiment, the second section is a connector that includes either a female luer fitting or a male luer fitting that seals with a complementary fitting formed as part of the fluid delivery device that is opposite in nature from the luer fitting at the second section. For example, the luer fittings can be in the form of a luer slip fitting or a luer lock fitting that produces a sealed fit between these two members.

Further aspects and features of the exemplary automated safety cap removal mechanism disclosed herein can be appreciated from the appended Figures and accompanying written description.

DETAILED DESCRIPTION OF PREFERRED EMBODIMENTS

Figure 1:
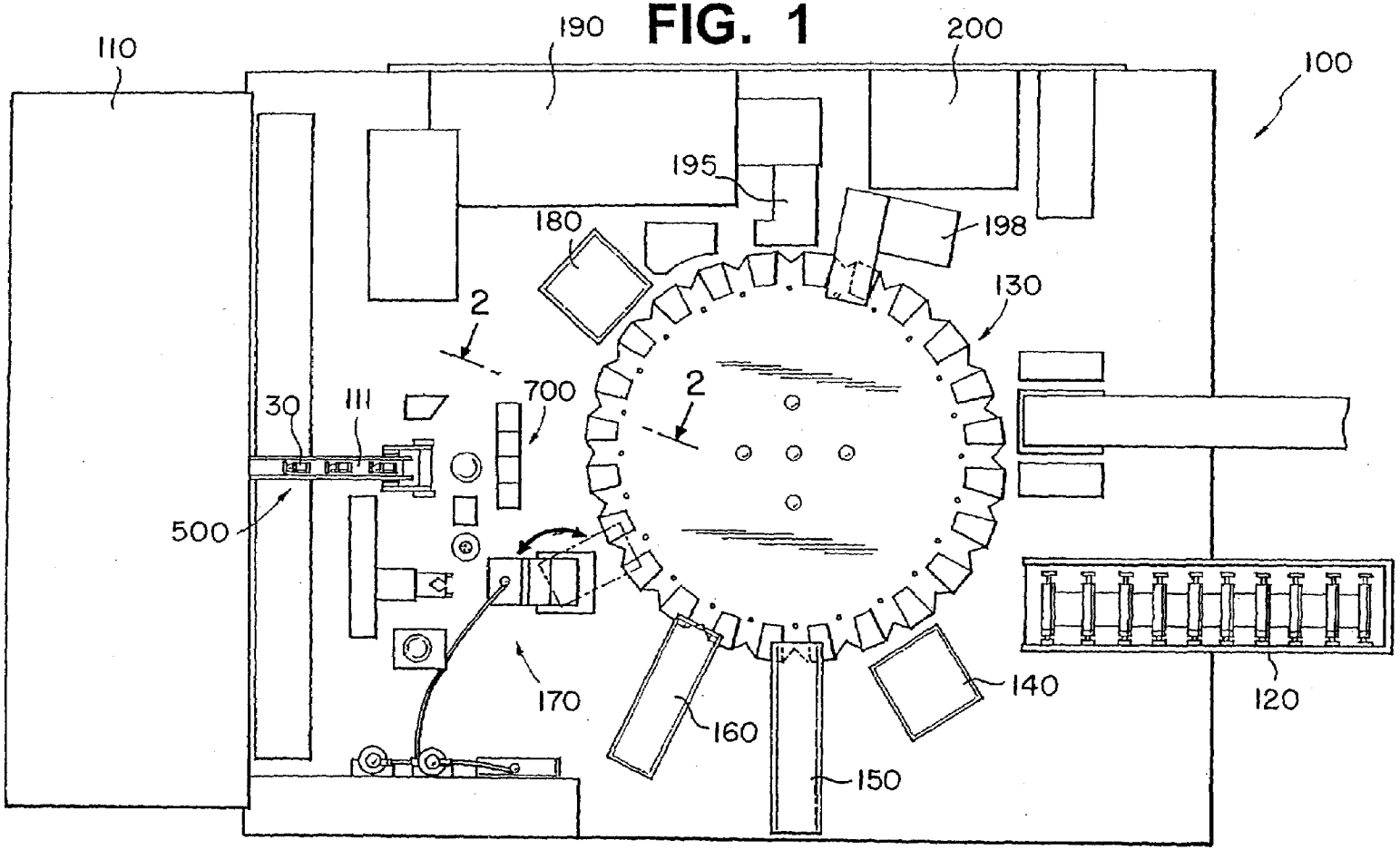
FIG. 1 is a diagrammatic plan view of an automated system for preparing a medication to be administered to a patient.
Figure 2:
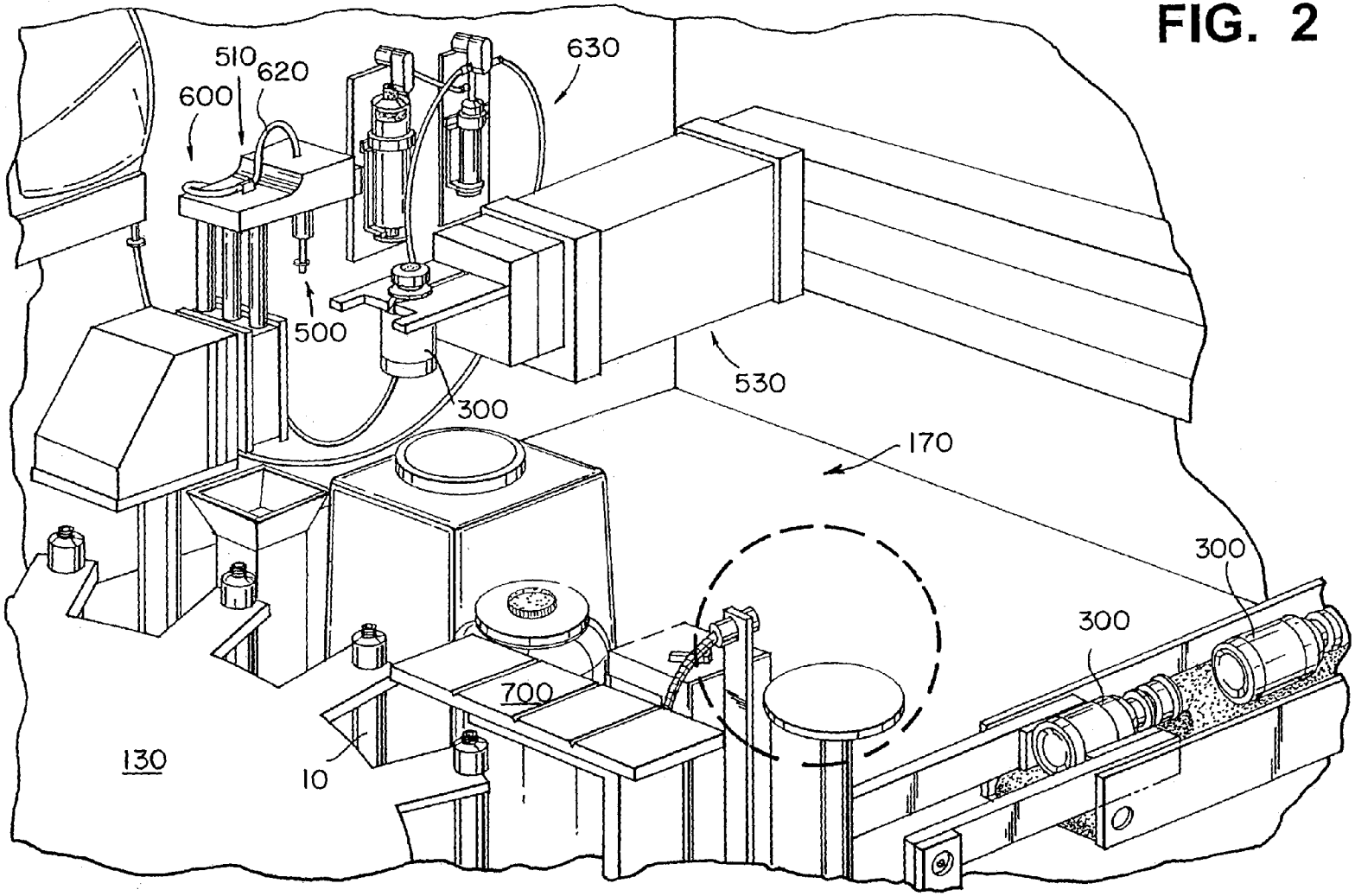
FIG. 2 is a local perspective view of fluid transfer and vial preparation equipment in a fluid transfer area of the automated system.

FIG. 1 is a schematic diagram illustrating one exemplary automated system, generally indicated at 100, for the preparation of a medication. The automated system 100 is divided into a number of stations where a specific task is performed based on the automated system 100 receiving user input instructions, processing these instructions and then preparing unit doses of one or more medications in accordance with the instructions. The automated system 100 includes a station 110 where medications and other substances used in the preparation process are stored. As used herein, the term "medication" refers to a medicinal preparation for administration to a patient. Often, the medication is initially stored as a solid, e.g., a powder, to which a diluent is added to form a medicinal composition. Thus, the station 110 functions as a storage unit for storing one or medications, etc. under proper storage conditions. Typically, medications and the like are stored in sealed containers, such as vials, that are labeled to clearly indicate the contents of each vial.

A first station 120 is a syringe storage station that houses and stores a number of syringes. For example, up to 500 syringes or more can be disposed in the first station 120 for storage and later use. The first station 120 can be in the form of a bin or the like or any other type of structure than can hold a number of syringes. In one exemplary embodiment, the syringes are provided as a bandolier structure that permits the syringes to be fed into the other components of the system 100 using standard delivery techniques, such as a conveyor belt, etc.

The system 100 also includes a rotary apparatus 130 for advancing the fed syringes from and to various stations of the system 100. A number of the stations are arranged circumferentially around the rotary apparatus 130 so that the syringe is first loaded at the first station 120 and then rotated a predetermined distance to a next station, etc. as the medication preparation process advances. At each station, a different operation is performed with the end result being that a unit dose of medication is disposed within the syringe that is then ready to be administered.

One exemplary type of rotary apparatus 130 is a multiple station cam-indexing dial that is adapted to perform material handling operations. The indexer is configured to have multiple stations positioned thereabout with individual nests for each station position. One syringe is held within one nest using any number of suitable techniques, including opposing spring-loaded fingers that act to clamp the syringe in its respective nest. The indexer permits the rotary apparatus 130 to be advanced at specific intervals.

At a second station 140, the syringes are loaded into one of the nests of the rotary apparatus 130. One syringe is loaded into one nest of the rotary apparatus 130 in which the syringe is securely held in place. The system 100 preferably includes additional mechanisms for preparing the syringe for use, such as removing a tip cap at station 150 and extending a plunger of the syringe at a fourth station 160. At this point, the syringe is ready for use.

The system 100 also preferably includes a reading device (not shown) that is capable of reading a label disposed on the sealed container containing the medication. The label is read using any number of suitable reader/scanner devices, such as a bar code reader, etc., so as to confirm that the proper medication has been selected from the storage unit of the station 110. Multiple readers can be employed in the system at various locations to confirm the accuracy of the entire process. Once the system 100 confirms that the sealed container that has been selected contains the proper medication, the container can be delivered to another station using an automated mechanism, such a robotic gripping device as will be described in greater detail. At this other station, the vial is prepared by removing the safety cap from the sealed container and then cleaning the exposed end of the vial. Preferably, the safety cap is removed on a deck of the automated system 100 having a controlled environment. In this manner, the safety cap is removed just-in-time for use.

The system 100 also preferably includes a fifth station (fluid transfer station) 170 for injecting or delivering a diluent into the medication contained in the sealed container and then subsequently mixing the medication and the diluent to form the medication composition that is to be disposed into the prepared syringe. At this fluid transfer station, the prepared medication composition is withdrawn from the container (i.e., vial) and is then delivered into the syringe. For example, a cannula can be inserted into the sealed vial and the medication composition then aspirated into a cannula set. The cannula is then withdrawn from the vial and is then rotated relative to the rotary apparatus 130 so that it is in line with (above, below, etc.) the syringe. The unit dose of the medication composition is then delivered to the syringe, as well as additional diluent if necessary or desired. The tip cap is then placed back on the syringe at a sixth station 180. A seventh station 190 prints and station 195 applies a label to the syringe and a device, such as a reader, can be used to verify that this label is placed in a correct location and the printing thereon is readable. Also, the reader can confirm that the label properly identifies the medication composition that is contained in the syringe. The syringe is then unloaded from the rotary apparatus 130 at an unloading station 200 and delivered to a predetermined location, such as a new order bin, a conveyor, a sorting device, or a reject bin. The delivery of the syringe can be accomplished using a standard conveyor or other type of apparatus. If the syringe is provided as a part of the previously-mentioned syringe bandolier, the bandolier is cut prior at a station 198 located prior to the unloading station 200. The various devices that form a part of the system 100 as well as a detailed explanation of the operations that are performed at each station are described in greater detail in U.S. patent application Ser. Nos. 10/728,371; 10/426,910; 10/728,364; and 10/728,363 as well as International patent application Ser. No. PCT/US03/38581, all of which are hereby incorporated by reference in their entirety.

Figure 4:
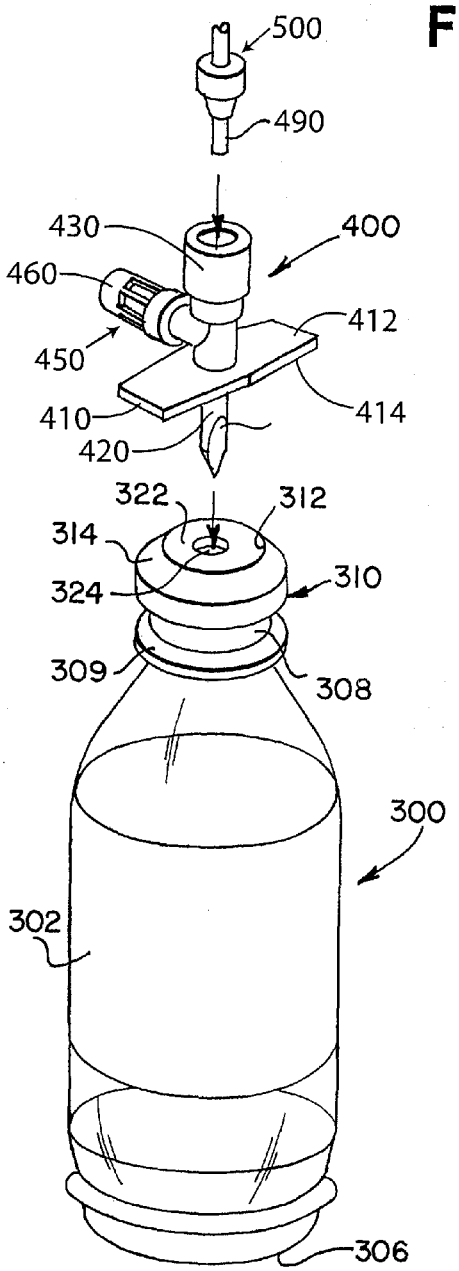
FIG. 4 is an exploded perspective view of a drug vial and a fluid transfer device (dispensing pin) according to a first embodiment.
Figure 5:
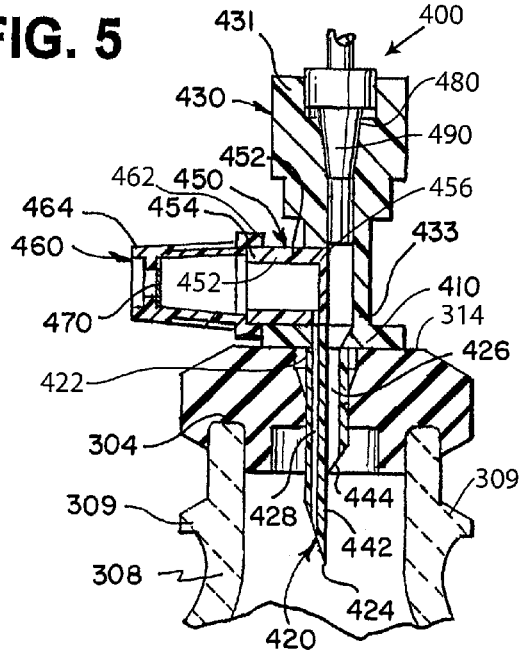
FIG. 5 is a cross-sectional view of the fluid transfer device of FIG. 4 being sealingly mated with a septum of the drug vial.
Figure 6:
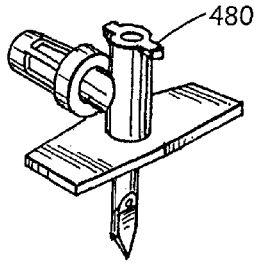
FIG. 6 is a perspective view of a fluid transfer device according to a second embodiment.

FIGS. 4–5 shows one type of drug vial 300 that in its simplest terms is a drug container that has a vial body 302 for storing a drug and a cap member or some other type of closure element 310 that is sealingly mated to an open end 304 of the drug container 300 opposite a closed end 306. The cap member 310 can be releasably attached to the open end 304 or it can be permanently attached after the contents are disposed within the vial body 302. The vial body 302 is preferably made of a transparent material so that the contents therein are visible, with one preferred material being glass. The illustrated drug vial 300 has a neck portion 308 near the open end 304 that tapers inwardly from a lower section of the vial body 302 such that the open end 304 has a diameter that is less than a diameter of the closed end 306. The neck portion 308 can also include an annular flange 309 that extends therearound and can be used to assist an individual or a robot that is part of an automated system in grasping and holding the drug vial 300 and moving it from one location to another one. In addition, the open end 304 itself can include an annular flange member (not shown) that is formed thereat to assist in attaching the cap member 310 to the vial body 302 as explained below.

The illustrated cap member 310 is of the type that includes a central opening 312 formed therethrough. As shown, the central opening 312 is preferably a circular opening that it formed over the opening of the end 304 of the vial body 302. This permits the contents in the vial body 302 to selectively travel through open end 304 and through the central opening 312. The exemplary cap member 310 is made of a metal material and can be crimped onto or otherwise attached to the annular flange member at the open end 302 such that a peripheral planar top surface 314 that is formed around and defines the central opening 312 is disposed over the opening at end 304.

The drug vial 300 also includes a pierceable septum 320 that is at least partially disposed within the vial body 302 and more particularly within the open end 304. The pierceable septum 320 can be in the form of a rubber stopper that is generally hollow and includes a top surface 322 of reduced thickness to permit a cannula or the like to easily pierce the top surface of the septum 320. Once the top surface 322 is pierced, the transfer device that pierced the surface can communicate directly with the interior of the vial body 302 and more particularly can be placed into contact with the contents in the vial body 302 for the purpose of withdrawing the contents or in the case where the cannula is used to inject a fluid into the vial body 302, the transfer device merely needs to pierce the septum 320 and be placed within the vial body 302. To create an even more easily pierceable top surface, the top surface 322 can include a recessed portion 324 (e.g., a dimple) that that is of reduced thickness relative to the surrounding portions of the septum 320. Since the recessed portion 324 is preferably centrally located in the top surface 322, any transfer device that pierces the recessed portion 324 will be centrally located within the interior of the vial body 302.

Now referring to FIGS. 2–5, the present invention, in part, concerns the use of a transfer device 400 that is constructed to be inserted through the recessed portion 324, if present, or to pierce the top surface 322 of the septum 320 when the recessed portion 324 is not included as part of the septum 320. FIG. 4 is a perspective view of one exemplary transfer device 400. The transfer device 400 can be thought of as a dispensing pin that is designed to be inserted and left in the septum 320 over a period of time so that a portion thereof is in communication with the interior of the vial body 302 and another section is disposed above the septum 320 (exterior to the drug vial) and is adapted to mate with a member that can deliver a fluid to or withdraw the contents of the vial body 302 or can do both.

The transfer device 400 has a base section 410 with a piercing element 420 extending outwardly from one surface 412 thereof and a connector 430 extending outwardly from an opposite surface 414 thereof. In the exemplary embodiment, when the transfer device 400 pierces the septum 320 as in a normal application, the one surface 412 is an underside of the base section 410, while the opposite surface 414 is a top surface thereof. The base section 410 is in the form of a support member from which the piercing element 420 and the connector 430 are integrally attached and extend therefrom. The illustrated base section 410 has a rectangular shape with the piercing element 420 and the connector 430 being located in a central region of the base section 410. The piercing element 420 and the connector 430 are axially aligned and an opening is formed through the base section to permit the bore or passageway. formed axially within the piercing element 420 to be in direct fluid communication with the bore or passageway formed axially within the connector 430.

It will be appreciated that the base section 410 also provides an element which the user can easily grip and apply pressure thereto in order to either insert the transfer device 400 through the septum 320 or to withdraw it therefrom.

The piercing element 420 has a first end 422 that is integrally connected to the one surface 412 and an opposite end 424 that acts as a distal end. The distal end 424 is the part of the transfer device 400 that pierces the top surface 322 of the septum 320. The distal end 424 thus preferably comes to a point or the like that can easily puncture the top surface 322 when pressure is applied and the transfer device 400 is directed downward toward and into contact with the septum 320. The illustrated distal end 424 thus is in the form of a sharp pointed end.

The shape of the piercing element 420 is variable. For example, the illustrated piercing element 420 has a body that has a generally cylindrical shape; however, the body can be square shaped, triangular shaped, oval or oblong shaped, etc. As best shown in FIG. 4, the sharp pointed distal end 424 is formed by an inward taper that defines a generally conical shape body section at the distal end 424. However, the distal end 424 does not have a complete conical shape but rather a cut out or wedge 440 is formed therein. The wedge 440 is formed such that it includes two distinct sections, namely a first section 442 that is a planar section formed substantially perpendicular to the top surface 322 and a second section 444. The first section 442 thus has a surface that is formed along the longitudinal axis of the piercing element 420. The second section 444 is a beveled section relative to the first section 442.

The piercing element 420 has a first channel 426 and a second channel 428 formed therein. The first channel 426 is in direct fluid communication with the interior of the connector 430 and more particularly extends though an aligned opening formed through the base section 410 and into a hollow interior 432 of the connector 430. Accordingly, one will understand that the first channel 426 acts as a fluid passage way that is in direct communication at one end with the connector 430 and at the other end is in direct fluid communication with the interior of the drug vial 300 when the transfer device 400 pierces the septum 320. It is thus the first channel 426 that serves as the passageway or channel for either delivering a fluid to the drug vial 300 through the connector 430 or it can serve as a passageway for removing or aspirating a fluid from the drug vial 300 out through the connector 430.

The connector 430 is a member that extends outwardly from the opposite surface 414 and is designed to mate with a cannula device or the like. The connector 430 is formed of a generally hollow body that includes the interior or cavity 432. Similar to the piercing element 420, the connector 430 has a body that has an open first end 431 and an opposite second end 433 that is integrally attached to the opposite surface 414 of the base section 410. The body of the connector 430 can be formed to have any number of shapes, such as square, rectangular, triangular, oval or oblong, etc. The illustrated connector 430 has a generally cylindrical shape that is hollow due to the presence of the cavity 432. The cavity 432 is a bore formed through the body and is open at both the first end 431 and the second end 433. The cavity 432 is also in fluid communication with the opening formed through the base section 410 that is aligned with the first channel 436.

The transfer device 400 also has a vent 450, such as an atmospheric air vent, that is in fluid communication with the cavity 432 of the connector 430 and the second channel 428 formed through the piercing element so as to permit a fluid (air) to flow between the interior of the drug vial 300 and the surrounding atmosphere.

The vent 450 is formed of a body 452 that is preferably disposed substantially perpendicular to the body of the connector 430 and is preferably formed at the second end 433 thereof. Like the other members, the body 452 can come in any number of different shapes, such as square, triangular, oval or oblong, etc. The illustrated body 452 is a generally hollow member that has a generally cylindrical shape and has an open first end 454 and an opposing second end 456 that is integrally connected to the body of the connector 430 near the second end 433. More specifically, the connector body includes a side opening formed at or near the second end 433 and the body 452 is integrally formed around this side opening so that the open interiors of the connector 430 and the vent 450 are in fluid communication with one another. The side opening can be constructed so that it does not have an entirely circular shape opening, such as the opening formed at the second end 456 of the vent body; but rather, the side opening can be less than a circular opening, e.g., a semi-circular shaped opening, so as to limit and control the venting. For example, the side opening can be partially obstructed by a member that assists in preventing a liquid flowing between the connector interior and the first channel 426 from entering the vent 450. In other words, the vent 450 is constructed and orientated so that it functions only to pass air from and to the atmosphere as opposed to handling other fluids, such as liquid being delivered or aspirated by means of the cannula unit.

Since the body 452 is generally hollow, a cavity 453 is formed therein and is open at the first end 454, where an entrance to the cavity of the connector 430 is formed, and is likewise open at the second end 456 to permit air to flow therein. The body 452 therefore resembles a tube.

The vent 450 preferably includes a removeable cap 460 that is fittingly disposed around the body 452 at the second end 456 thereof such that the cap 460 can slide along the outer surface of the body 452 to properly position the cap 460 on the vent body 452. The cap 460 is a generally hollow member that includes an open first end 462 and a partially open second end 464. The first end 462 and the hollow interior are dimensioned so that the vent body 452 can by snugly received therein in order to mate the cap 460 with the vent body 452. When the cap 460 is pushed over the vent 450, a side edge of the base section 410 acts as a stop surface since the first end 462 of the cap 460 contacts this side edge which restricts the degree of travel of the cap 460 along the outer surface of the vent body.

The cap 460 preferably has a filter element 470 incorporated therein at the second end 464 thereof. For example, the partially open second end 454 can have a small opening formed therein that provides an entrance into the hollow interior of the cap 460. The filter element 470 is disposed across this opening and serves to filter material that may be present in the surrounding air and more specifically, during a typical application air travels through the filter element 470 and vent 450 and into the drug vial 300 to displace removed fluid. One exemplary filter element 470 is a 5 micron filter that filters air that passes therethrough. The opening 465 can optionally have one or more small support structures that extend partially across the opening 465 to provide a backbone for supporting the filter element 470. For example, one or more support beams or cross members can be formed across the opening 465 and in the illustrated embodiment, the cross members are disposed in a cross hair arrangement. The cross members lessen the chance that the filter element 470 can become displaced from the cap body or be pushed into the hollow interior of the cap 460.

FIGS. 2 through 14 illustrate parts of the fluid transfer station 170 for preparing the syringe for later use in which the transfer device 400 is used in the delivery and/or withdrawal of fluid from the vial 300. In other words, FIGS. 2–14 illustrate in more detail the station and automated devices associated therewith that are used for filling the barrel chamber with medication. Referring to FIGS. 2–5, the connector 430 is constructed so that it mates with a complementary fitting that forms a part of a cannula unit 500. More specifically, depending upon its specific type, the connector 430 can act as a female luer fitting or a male luer fitting. As is known, a luer fitting is a paired, complementary male-female interference fitting that creates a continuous fluid pathway by joining two segments, one of which has a male fitting and the other of which has the female fitting. There is a slight difference between the male fitting and the female fitting in that angled ramp-like structures that are formed as a part thereof create angles that cause an interference fit to occur when the male fitting is inserted into the female fitting. One type of luer fitting is a luer slip fitting that relies on the process of manually pressing the two fittings together to create the sealed fluid path way. The fitting is thus provided by simple pressing the male fitting into the female fitting such that a seal is formed therebetween. The fitting can be easily disassembled by simply pulling the male fitting out of the female fitting.

Another type of luer fitting that can be used is a luer lock fitting that relies on a screw action to press the male fitting into the female fitting to create a sealed fluid pathway. In such a mechanism, the female fitting has helical screws or tabs that engage a screw collar surrounding the male fitting. The fitting joint is created when a user inserts the male fitting into the female fitting and then rotates the two fittings so that the tabs engage the threads in the screw collar around the male fitting. The resulting rotation causes the fittings to be pressed together. Such a fitting requires a counter rotating motion to disassemble the fitting.

It will be understood that in order for a luer lock fit to occur, both the female and male fittings have to have luer locking features. For example, the present of tabs or helical screws on the female portion of the fitting alone is obviously not sufficient to create a luer lock fitting. If the male member does not have the complementary screw collar, then the fitting is still a luer slip fitting. Similarly, the presence of a screw collar on a male luer fitting along cannot make a luer lock fitting. If the female luer fitting has nothing to engage those threads, the fitting is still a luer slip fitting.

Thus, in order to provide a sealed fit between a fluid transfer device and the connector 430, complementary fitting features must be provided at both the distal end of the fluid transfer device and the first end 431 of the connector body. In the illustrated embodiment, the connector portion 430 of the transfer device 400 is in the form of a female luer slip fitting 480 and the distal end of the fluid transfer device is in the form of a male luer slip fitting 490. This permits the two fittings to be easily pressed together to form a sealed fitting joint. The female luer slip fitting 480 is thus constructed so that it can receive and seal with the male luer slip fitting 490 in a sliding manner and then can be pulled apart without having to rotate any of the two fittings 480, 490.

The illustrated female luer slip fitting 480 can be engaged by one of two male luer slip fittings, namely (1) a male luer slip fitting on an end of a tube that comes from a pumping system that is used to deliver a fluid into the drug vial 100 for reconstitution of the drug as shown in FIGS. 2–5; or (2) a male luer slip or luer lock fitting formed at the end of a syringe (or cannula) for withdrawing fluid from the drug vial 100 via the transfer device 400. By using a female luer slip fitting 480 as part of the transfer device 400, it is possible to engage a luer slip fitting on either of the two above male luer fittings without having to rotate the components to produce a sealed fit or to remove them from one another.

In other words and it will be appreciated that the transfer device 400, and more particularly the connector 430 thereof can have any number of different luer type fittings that complement the type of luer fitting that is found on the mating article, e.g., a tube or syringe and which can be of the locking or non-locking type. In an alternative embodiment, shown in FIG. 6, the female luer fitting 480 is in the form of a locking type that is intended to mate with a complementary male luer of the locking type.

The transfer device 400 can be formed from a number of different materials, including a plastic material. For example, the transfer device 400 can be a plastic molded member which is light weight, durable and inexpensive to manufacture.

Figure 3:
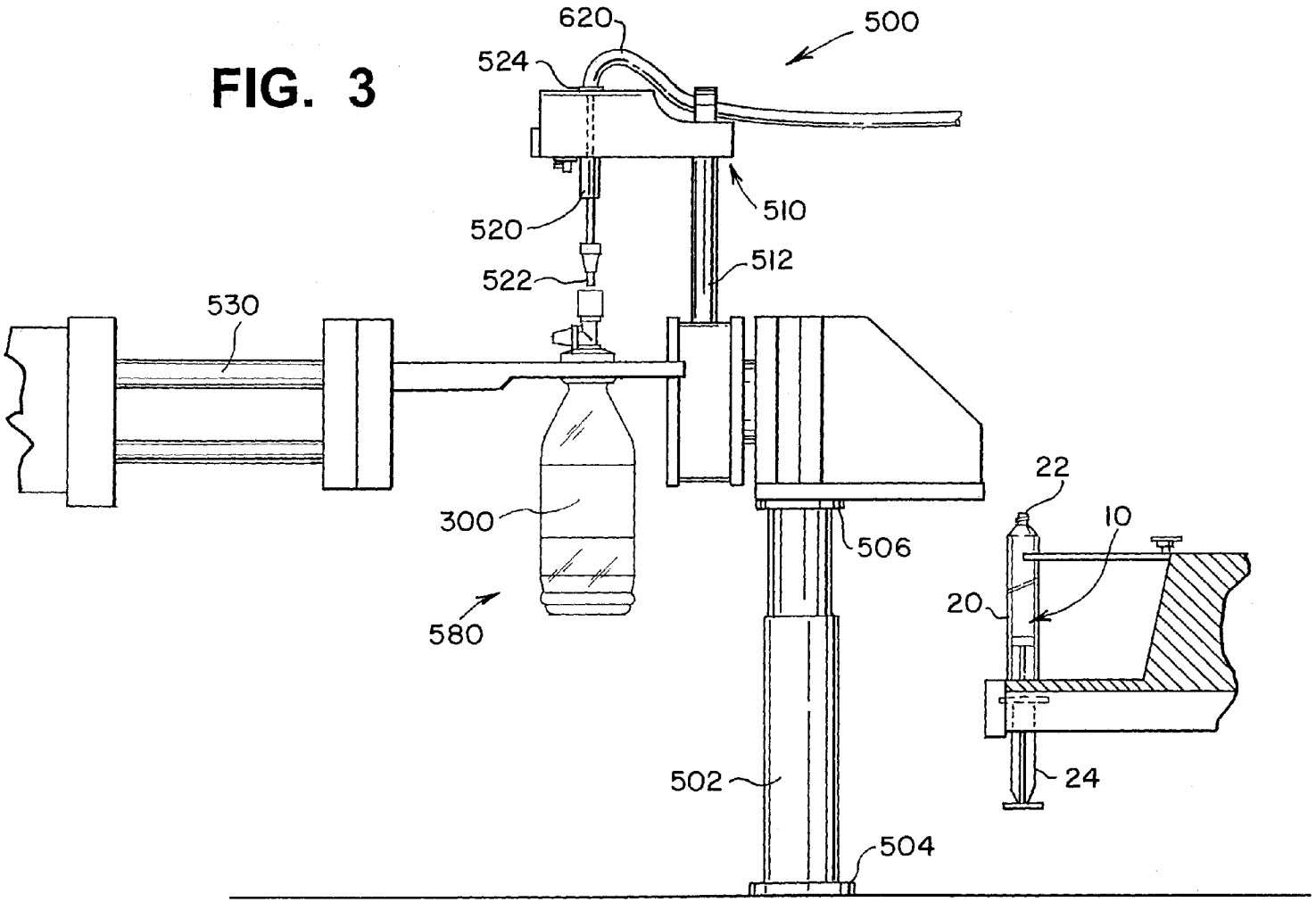
FIG. 3 is a side elevation view of a fluid transfer device in a first position where a cannula unit is in an extended position and a vial gripper device moves the vial into a fluid transfer position.

As shown in FIG. 3, one exemplary cannula unit 500 can include a vertical housing 502 that is rotatably coupled to a base 504 between the ends thereof. At an upper end 506 of the housing 502, a cannula housing 510 is operatively coupled thereto such that the cannula housing 510 can be independently moved in a controlled up and down manner so to either lower it or raise it relative to the drug vial 300, and more particularly, the transfer device 400, in the fluid transfer position. For example, the cannula housing 510 can be pneumatically operated and therefore, can include a plurality of shafts 512 which support the cannula housing 510 and extend into an interior of the vertical housing 502 such that when the device is pneumatically operated, the shafts 512 can be driven either out of or into the housing 502 resulting in the cannula housing 510 either being raised or lowered, respectively.

At one end of the cannula housing 510 opposite the end that is coupled to the vertical housing 502, the cannula housing 510 includes a cannula 520. The cannula 520 has a distal end 522 that serves to interact with the transfer device 400 for delivering or withdrawing fluid from the drug vial 300 and an opposite end 524 that is operatively coupled to a fluid source, such as a diluent, via tubing or the like.

A robotic device 530 then advances forward to a fluid transfer station 530. The fluid transfer station 530 is an automated station where the medication (drug) can be processed so that it is in a proper form for injection into one of the syringes 10 that is coupled to the rotary dial 130. When the vial 300 contains only a solid medication and it is necessary for a diluent (e.g., water or other fluid) to be added to liquify the solid, this process is called a reconstitution process. Alternatively and as will be described in detail below, the medication can already be prepared and therefore, in this embodiment, the fluid transfer station is a station where a precise amount of medication is simply aspirated or withdrawn from the vial 300 and delivered to the syringe 10.

The precise steps of a reconstitution process and of an aspiration process using the cannula unit 500 are described in great detail in the previously incorporated U.S. patent applications which are assigned to the present assignee.

One type of cannula unit 500 includes a fluid delivering system 600 which includes a main conduit 620 that is operative coupled to the cannula 520 for delivering fluid thereto in a controlled manner, with an opposite end of the main conduit 620 being connected to a fluid pump system 630 that provides the means for creating a negative pressure in the main conduit 620 to cause a precise amount of fluid to be withdrawn into the cannula 520 and the main conduit 620 as well as creating a positive pressure in the main conduit 620 to discharge the fluid (either diluent or medication) that is stored in the main conduit 620 proximate the cannula 520. In the illustrated embodiment shown in FIG. 14, the fluid pump system 630 includes a first syringe 632 and a second syringe 634, each of which has a plunger or the like 638 which serves to draw fluid into the syringe or expel fluid therefrom. The main difference between the first and second syringes 632, 634 is that the amount of fluid that each can hold. In other words, the first syringe 632 has a larger diameter barrel and therefore has increased holding capacity relative to the second syringe 634. As will be described in detail below, the first syringe 632 is intended to receive and discharge larger volumes of fluid, while the second syringe 634 performs more of a fine tuning operation in that it precisely can receive and discharge small volumes of fluid.

The syringes 632, 634 are typically mounted so that an open end 636 thereof is the uppermost portion of the syringe and the plunger 638 is disposed so that it is the lowermost portion of the syringe. Each of the syringes 632, 634 is operatively connected to a syringe driver, generally indicated at 640, which serves to precisely control the movement of the plunger 638 and thus precisely controls the amount (volume) of fluid that is either received or discharged therefrom. More specifically, the driver 640 is mechanically linked to the plunger 638 so that controlled actuation thereof causes precise movements of the plunger 638 relative to the barrel of the syringe. In one embodiment, the driver 640 is a stepper motor that can precisely control the distance that the plunger 638 is extended or retracted, which in turn corresponds to a precise volume of fluid being aspirated or discharged. Thus, each syringe 632, 634 has its own driver 640 so that the corresponding plunger 638 thereof can be precisely controlled and this permits the larger syringe 632 to handle large volumes of fluid, while the smaller syringe 634 handles smaller volumes of fluid. As is known, stepper motors can be controlled with a great degree of precision so that the stepper motor can be only be driven a small number of steps which corresponds to the plunger 638 being moves a very small distance. On the other hand, the stepper motor can be driven a large number of steps which results in the plunger 638 being moved a much greater distance. The drivers 640 are preferably a part of a larger automated system that is in communication with a master controller that serves to monitor and control the operation of the various components. For example, the master controller calculates the amount of fluid that is to be either discharged from or aspirated into the cannula 520 and the main conduit 620 and then determines the volume ratio as to how much fluid is to be associated with the first syringe 632 and how much fluid is to be associated with the second syringe 634. Based on these calculations and determinations, the controller instructs the drivers 640 to operate in a prescribed manner to ensure that the precise amount of volume of fluid is either discharged or aspirated into the main conduit 620 through the cannula 520.

The open end 636 of each syringe 632, 634 includes one or more connectors to fluidly couple the syringe 632, 634 with a source 650 of diluent and with the main conduit 620. In the illustrated embodiment, the first syringe 632 includes a first T connector 660 that is coupled to the open end 636 and the second syringe 634 includes a second T connector 662 that is coupled to the open end 636 thereof. Each of the legs of the T connectors 660, 662 has an internal valve mechanism or the like 670 that is associated therewith so that each leg as well as the main body that leads to the syringe itself can either be open or closed and this action and setting is independent from the action at the other two conduit members of the connector. In other words and according to one preferred arrangement, the valve 670 is an internal valve assembly contained within the T connector body itself such that there is a separate valve element for each leg as well as a separate valve element for the main body. It will be appreciated that each of the legs and the main body defines a conduit section and therefore, it is desirable to be able to selectively permit or prevent flow of fluid in a particular conduit section.

In the illustrated embodiment, a first leg 661 of the first T connector 660 is connected to a first conduit 656 that is connected at its other end to the diluent source 650 and the second leg 663 of the first T connector 660 is connected to a connector conduit (tubing) 652 that is connected at its other end to the first leg of the second T connector 662 associated with the second syringe 634. A main body 665 of the first T connector 660 is mated with the open end 636 of the first syringe 632 and defines a flow path thereto. The connector conduit 652 thus serves to fluidly connect the first and second syringes 632, 634. As previously mentioned, the valve mechanism 670 is preferably of the type that includes three independently operable valve elements with one associated with one leg 661, one associated with the other leg 663 and one associated with the main body 665.

With respect to the second T connector 662, a first leg 667 is connected to the connector conduit 652 and a second leg 669 is connected to a second conduit 658 that is connected to the main conduit 620 or can actually be simply one end of the main conduit. A main body 671 of the second T connector 662 is mated with the open end 636 of the second syringe 634. As with the first T connector 660, the second T connector 662 includes an internal valve mechanism 670 that is preferably of the type that includes three independently operable valve elements with one associated with one leg 667, one associated with the other leg 669 and one associated with the main body 671.

The operation of the fluid pump system 630 is now described with reference to FIGS. 2–14. If the operation to be performed is a reconstitution operation, the valve 670 associated with the second leg 669 is first closed so that the communication between the syringes and the main conduit 620 is restricted. The valve element 670 associated with first leg 661 of the T connector 660 is left open so that a prescribed amount of diluent can be received from the source 650. The valve element associated with the second leg 663 of the T connector 660 is initially closed so that the diluent from the diluent source 650 is initially drawn into the first syringe 630 and the valve element associated with the main body 665 is left open so that the diluent can flow into the first syringe 632. The driver 640 associated with the first syringe 632 is then actuated for a prescribed period of time resulting in the plunger 638 thereof being extended a prescribed distance. As previously mentioned, the distance that the driver 640 moves the corresponding plunger 638 is directly tied to the amount of fluid that is to be received within the syringe 632. The extension of the plunger 638 creates negative pressure in the first syringe 632, thereby causing diluent to be drawn therein.

Once the prescribed amount of fluid is received in the first syringe 632, the valve element associated with the main body 665 of the T connector 660 is closed and the valve element associated with the second leg 663 is open, thereby permitting flow from the first T connector 660 to the second T connector 662. At the same time, the valve element associated with the first leg 667 and the main body 671 of the second T connector 662 are opened (with the valve element associated with the second leg 669 being kept closed).

The driver 640 associated with the second syringe 634 is then actuated for a prescribed period of time resulting in the plunger 638 thereof being extended a prescribed distance which results in a precise, prescribed amount of fluid being drawn into the second syringe 634. The extension of the plunger 638 creates negative pressure within the barrel of the second syringe 634 and since the second T connector 662 is in fluid communication with the diluent source 650 through the first T connector 660 and the connector conduit 652, diluent can be drawn directly into the second syringe 632. The diluent is not drawn into the first syringe 660 since the valve element associated with the main body 665 of the first T connector 660 is closed.

Thus, at this time, the first and second syringes 632, 634 hold in total at least a prescribed volume of diluent that corresponds to at least the precise volume that is to be discharged through the cannula 520 into the vial 300 to reconstitute the medication contained therein.

It will be understood that all of the conduits, including those leading from the source 650 and to the cannula are fully primed with diluent prior to performing any of the above operations.

To discharge the prescribed volume of diluent into the vial, the process is essentially reversed with the valve 670 associated with the first leg 661 of the T connector 660 is closed to prevent flow through the first conduit 656 from the diluent source 650. The valve element associated with the second leg 669 of the second T connector 662 is opened to permit fluid flow therethrough and into the second conduit 658 to the cannula 520. The diluent that is stored in the first and second syringes 632, 634 can be delivered to the second conduit 658 in a prescribed volume according to any number of different methods, including discharging the diluent from one of the syringes 632, 634 or discharging the diluent from both of the syringes 634. For purpose of illustration only, it is described that the diluent is drawn from both of the syringes 632, 634.

The diluent contained in the first syringe 632 can be introduced into the main conduit 620 by opening the valve associated with the second leg 663 and the main body 665 of the first T connector 660 as well as opening up the valve element associated with the first leg 667 of the second T connector 662, while the valve element associated with the main body 671 of the second T connector 662 remains closed. The valve element associated with the second leg 669 remains open. The driver 640 associated with the first syringe 632 is operated to retract the plunger 638 causing a positive pressure to be exerted and resulting in a volume of the stored diluent being discharged from the first syringe 632 into the connector conduit 652 and ultimately to the second conduit 658 which is in direct fluid communication with the cannula 520. The entire volume of diluent that is needed for the reconstitution can be taken from the first syringe 632 or else a portion of the diluent is taken therefrom with an additional amount (fine tuning) to be taken from the second syringe 634.

Figure 8:
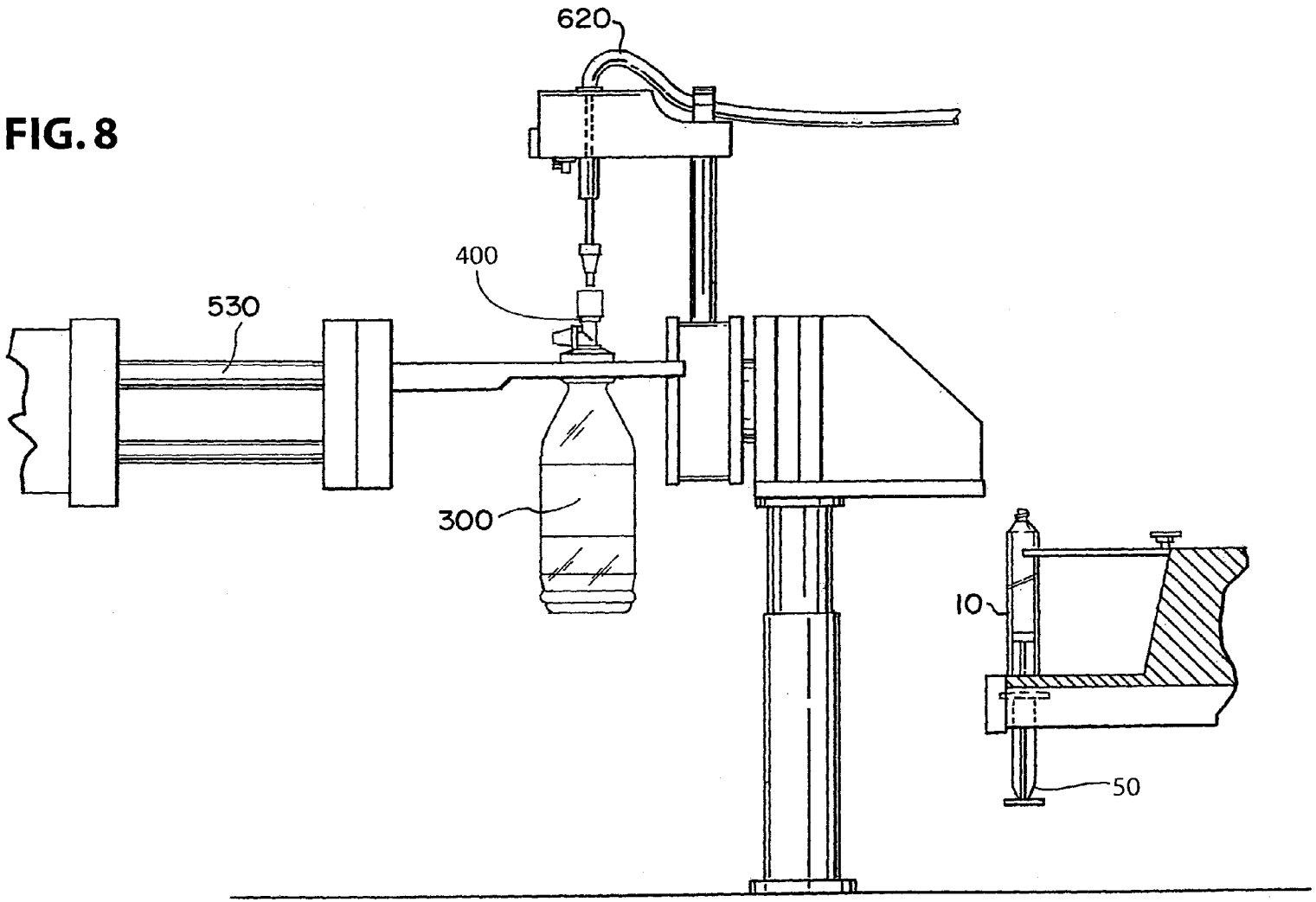
FIG. 8 is a side elevation view of the fluid transfer device in a second position in which the cannula is retracted into the vial to permit transfer either to or from the vial.

When it is desired to withdraw diluent from the second syringe 634, the valve associated with the first leg 667 of the second T connector 662 is closed (thereby preventing fluid communication between the syringes 632, 634) and the valve associated with the main body 671 of the second T connector 662 is opened. The driver 640 associated with the second syringe 634 is then instructed to retract the plunger 638 causing a positive pressure to be exerted and resulting in the stored diluent being discharged from the second syringe 634 into the second conduit 658. Since the second conduit 658 and the main conduit 620 are fully primed, any new volume of diluent that is added to the second conduit 658 by one or both of the first and second syringes 632, 634 is discharged at the other end of the main conduit 620. The net result is that the prescribed amount of diluent that is needed to properly reconstitute the medication is delivered through the cannula 520 and into the vial 300. These processing steps are generally shown in FIGS. 8–9 in which the cannula 520 pierces the septum of the vial and then delivers the diluent to the vial and then the cannula unit 590 and the vial gripper device 530 are inverted to cause agitation and mixing of the contents of the vial.

It will be understood that in some applications, only one of the first and second syringes 632, 634 may be needed to operate to first receive diluent from the diluent source 650 and then discharge the diluent into the main conduit 520.

Figure 9:
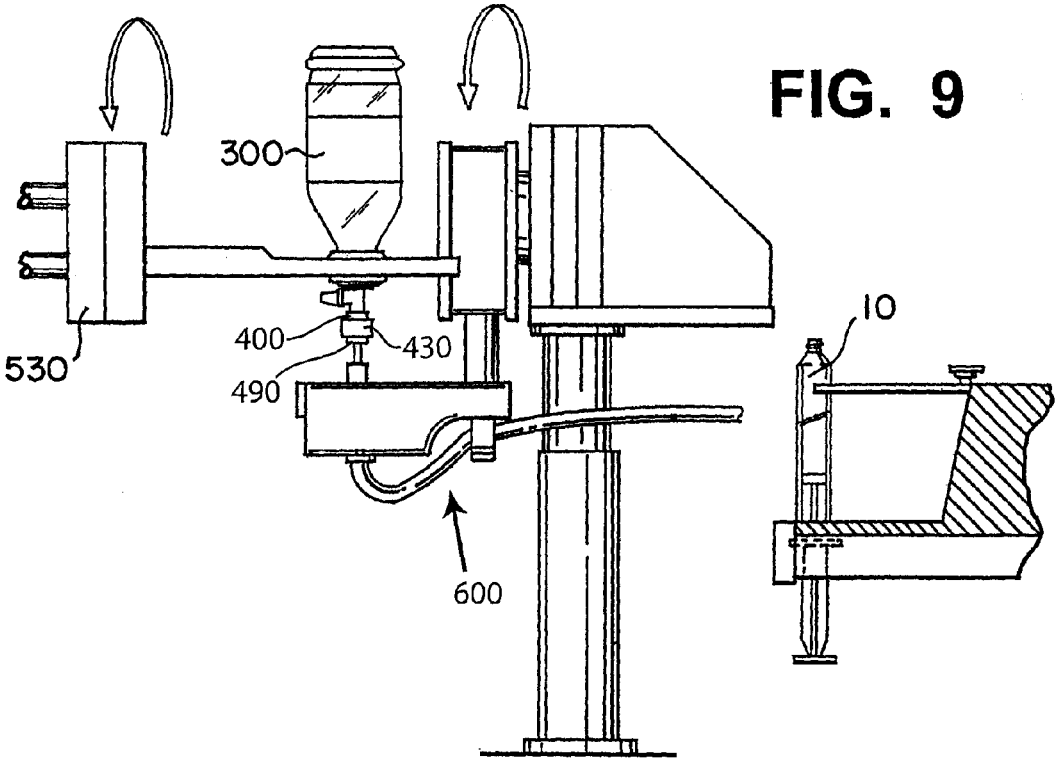
FIG. 9 is a side elevation view of the fluid transfer device in a third position in which the cannula unit and the vial gripper device are rotated to invert the cannula unit within the vial and to permit aspiration of the contents of the vial.
Figure 10:
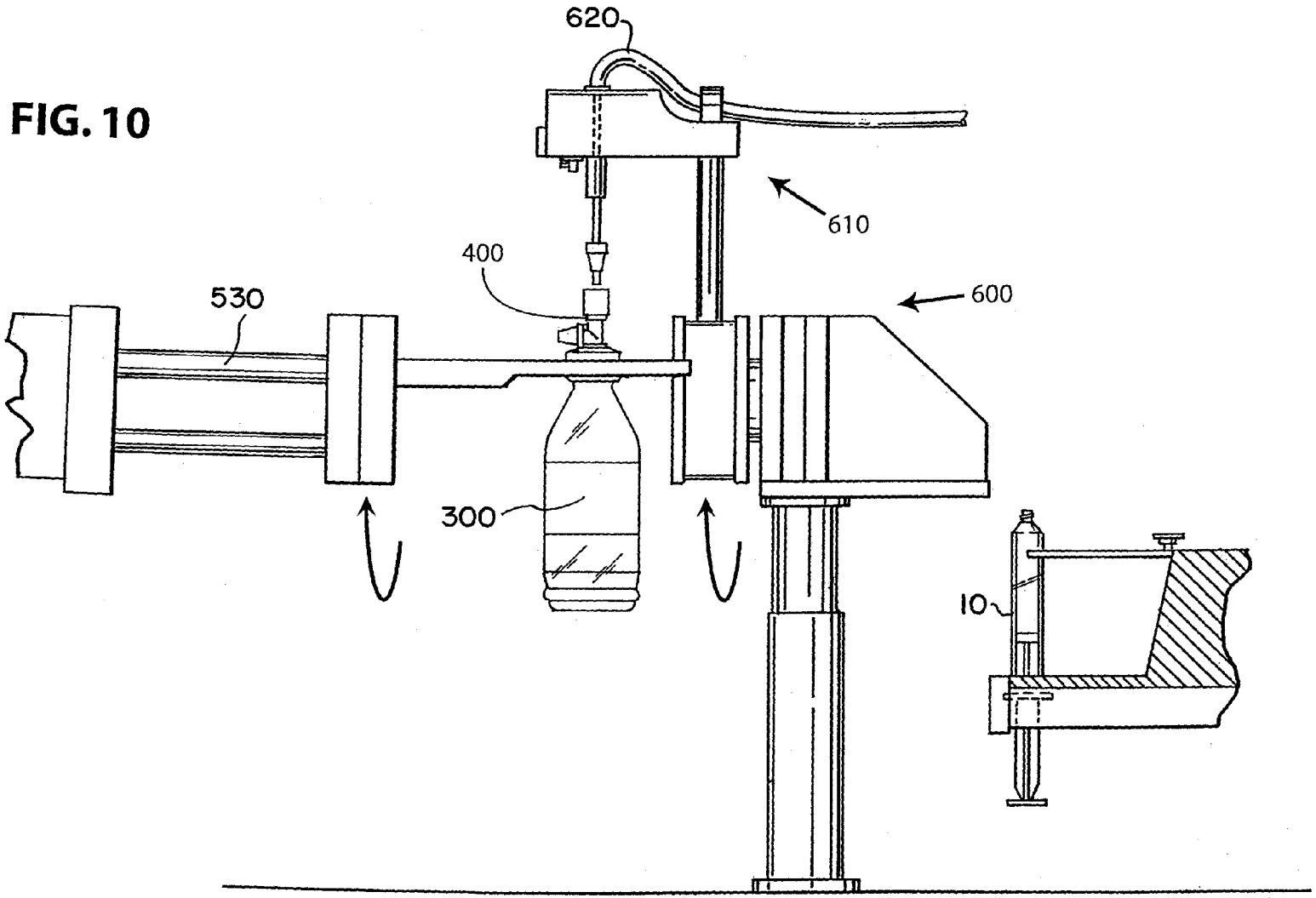
FIG. 10 is a side elevation view of the fluid transfer device in a fourth position in which the cannula unit and the vial gripper device are rotated back to the original positions.
Figure 11:
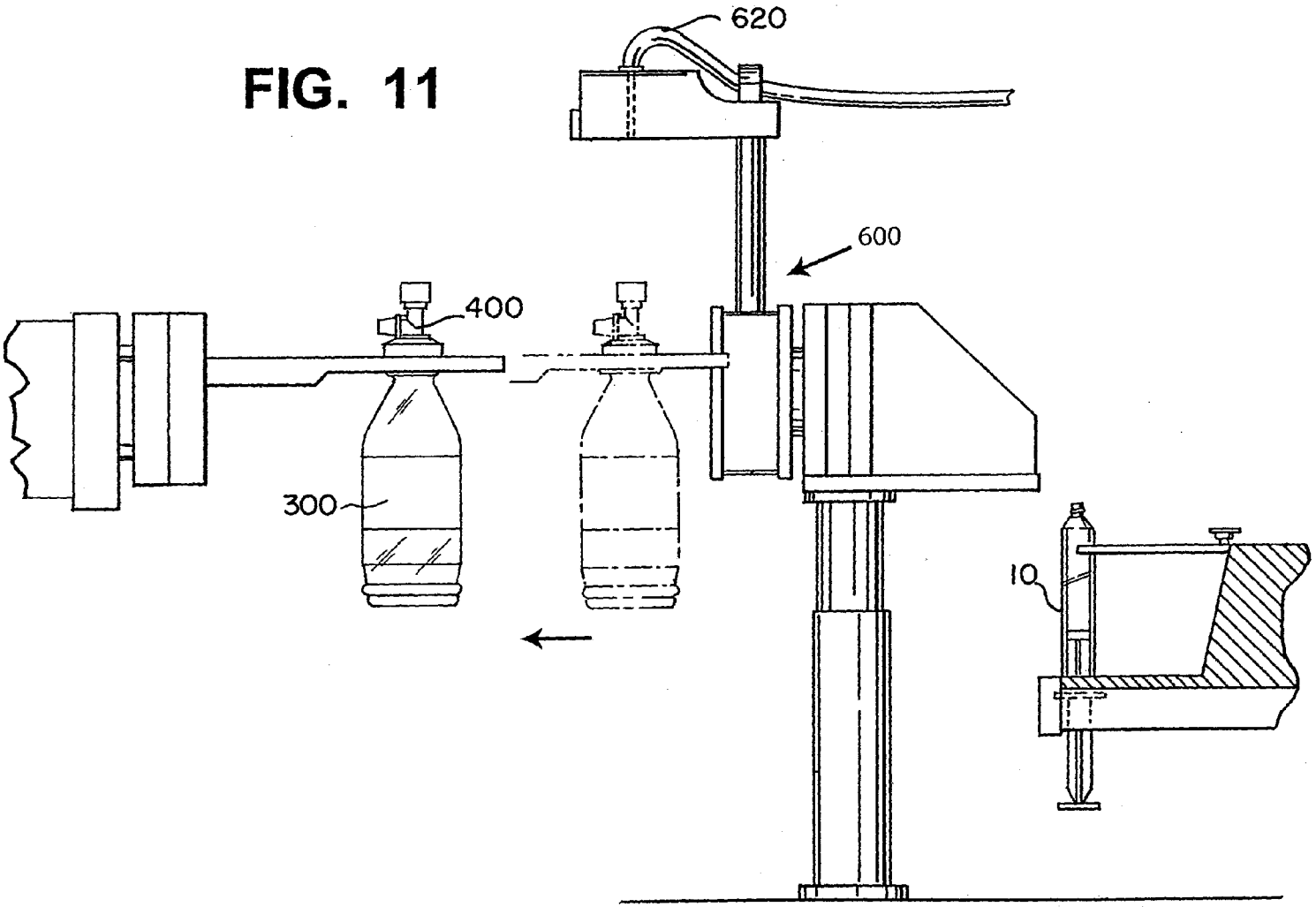
FIG. 11 is a side elevation view of the fluid transfer device in a fifth position in which the cannula unit is extended so that the cannula, with the aspirated medication, is removed from the vial.
Figure 12:
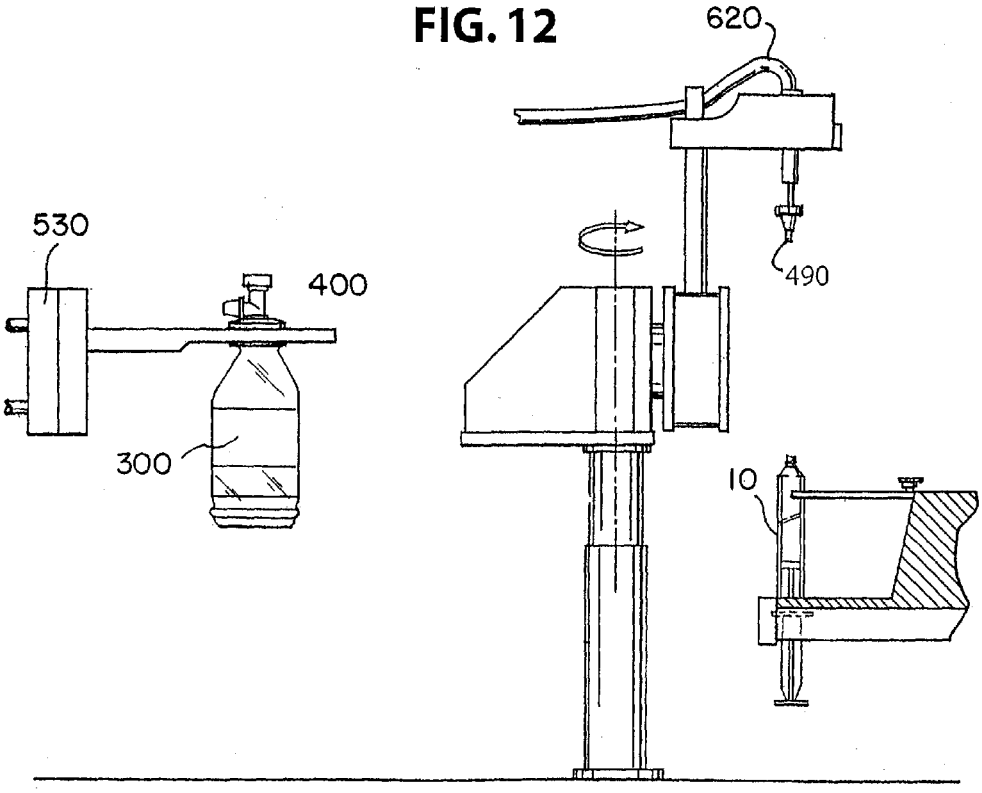
FIG. 12 is a side elevation view of the fluid transfer device in a sixth position in which the cannula unit is rotated to the rotary dial that contains the nested syringes.
Figure 13:
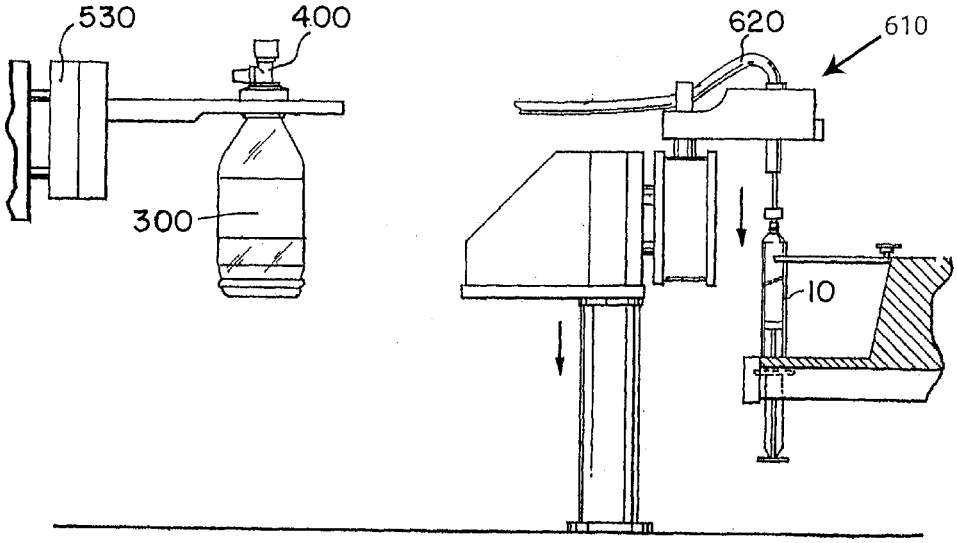
FIG. 13 is a side elevation view of the fluid transfer device in a seventh position in which the cannula unit is retracted so that the cannula thereof is inserted into the syringe to permit the aspirated fluid to be delivered to the syringe.
Figure 14:
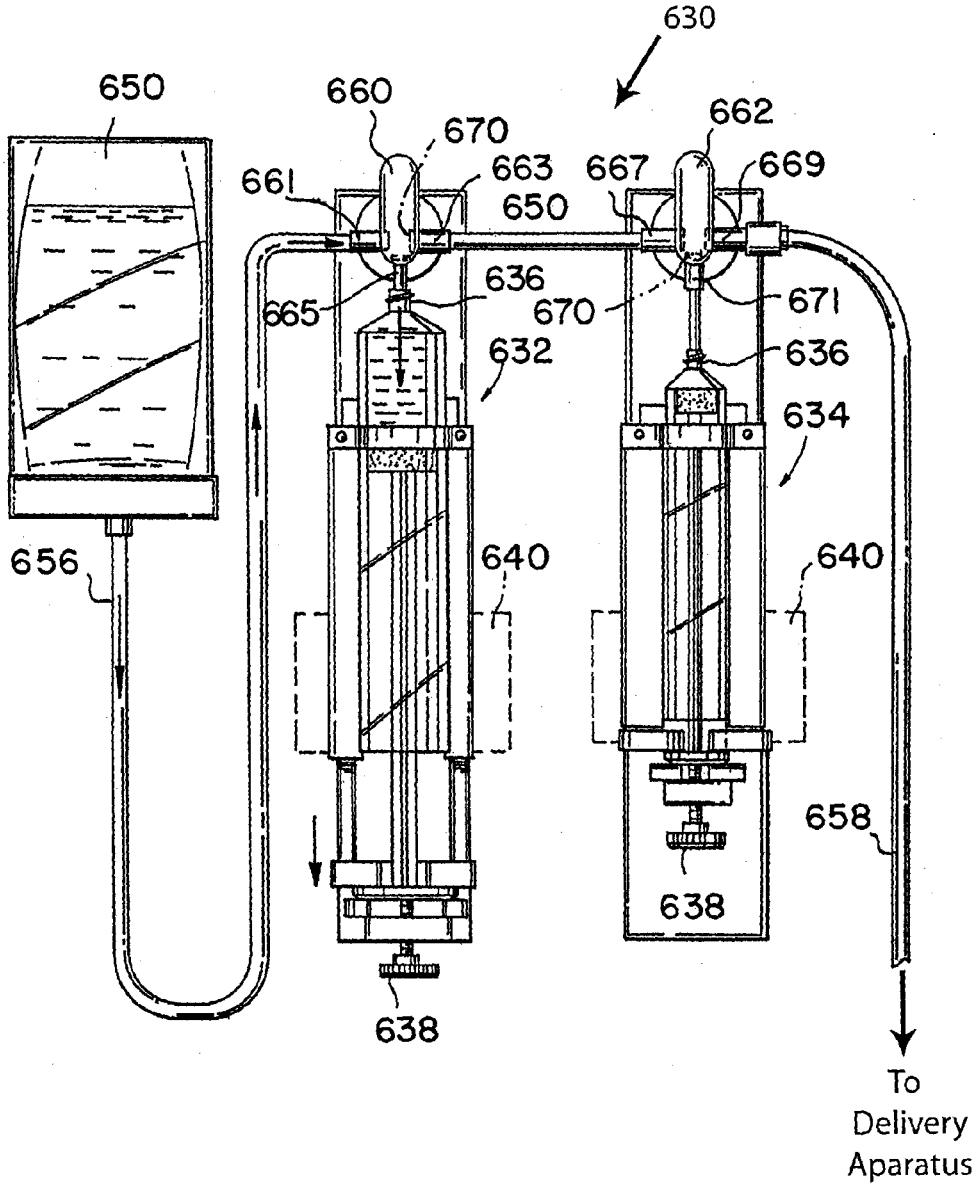
FIG. 14 is a side elevation view of a fluid pump system that is located in the fluid transfer area shown in a one operating position.

After the medication in the vial 300 has been reconstituted as by inversion of the vial and mixing, as described herein, the fluid pump system 630 is then operated so that a prescribed amount of medication is aspirated or otherwise drawn from the vial 300 through the cannula 520 and into the main conduit 620 as shown in FIG. 9. Before the fluid is aspirated into the main conduit 620, an air bubble is introduced into the main conduit 620 to serve as a buffer between the diluent contained in the conduit 620 to be discharged into one vial and the aspirated medication that is to be delivered and discharged into one syringe 10. It will be appreciated that the two fluids (diluent and prepared medication) can not be allowed to mix together in the conduit 620. The air bubble serves as an air cap in the tubing of the cannula and serves as an air block used between the fluid in the line (diluent) and the pulled medication. According to one exemplary embodiment, the air block is a 1/10 ml air block; however, this volume is merely exemplary and the size of the air block can be varied.

The aspiration operation is essentially the opposite of the above operation where the diluent is discharged into the vial 300. More specifically, the valve 670 associated with the first leg 661 of the first T connector 660 is closed and the valve associated with the second leg 669 of the second T connector 662 is opened to permit flow of the diluent in the main conduit into one or both of the syringes 632, 634. As previously mentioned, the second syringe 634 acts more as a means to fine tune the volume of the fluid that is either to be discharged or aspirated.

The drivers 640 associated with one or both of the first and second syringes 632, 634 are actuated for a prescribed period of time resulting in the plungers 638 thereof being extended a prescribed distance (which can be different from one another). As previously mentioned, the distance that the drivers 640 move the corresponding plungers 638 is directly tied to the volume of fluid that is to be received within the corresponding syringe 632, 634. By extending one or both of the plungers 638 by means of the drivers 640, a negative pressure is created in the main conduit 620 as fluid is drawn into one or both of the syringes 632, 634. The creation of negative pressure within the main conduit 620 and the presence of the tip end of the cannula 520 within the medication translates into the medication being drawn into the cannula 520 and ultimately into the main conduit 620 with the air block being present therein to separate the pulled medication and the fluid in the line.

It will be appreciated that the aspiration process can be conducted so that fluid is aspirated into one of the syringes 632, 634 first and then later an additional amount of fluid can be aspirated into the other syringe 632, 634 by simply controlling whether the valves in the main bodies 665, 671 are open or closed. For example, if fluid is to be aspirated solely to the first syringe 632, then the valve elements associated with the first and second legs 667, 669 of the second T connector 662 and the valve element associated with the second leg 663 and main body 665 of the first T connector 660 are all open, while the valve elements associated with the first leg 661 of the T connector 660 and the main body 671 of the T connector 662 remain closed. After a sufficient volume of fluid has been aspirated into the first syringe 632 and it is desired to aspirate more fluid into the second syringe 634, then the valve element associated with the first leg 667 simply needs to be closed and then the driver 640 of the second syringe 634 is actuated to extend the plunger 638.

After aspirating the medication into the main conduit 620, the fluid transfer device 580 is rotated as is described below to position the cannula 520 relative to one syringe 10 that is nested within the rotary dial 130 as shown in FIGS. 10-13. Since the plungers 638 are pulled a prescribed distance that directly translates into a predetermined amount of medication being drawn into the main conduit 620, the plungers 638 are simply retracted (moved in the opposite direction) the same distance which results in a positive pressure being exerted on the fluid within the main conduit 620 and this causes the pulled medication to be discharged through the cannula 520 and into the syringe 10. During the aspiration operation and the subsequent discharge of the fluid, the valves are maintained at set positions so that the fluid can be discharged from the first and second syringes 632, 634. As the plungers 638 are retracted and the pulled medication is discharged, the air block continuously moves within the main conduit 620 toward the cannula 520. When all of the pulled (aspirated) medication is discharged, the air block is positioned at the end of the main conduit signifying that the complete pulled medication dose has been discharged; however, none of the diluent that is stored within the main conduit 620 is discharged into the syringe 10 since the fluid transfer device 580, and more particularly, the drivers 640 thereof, operates with such precision that only the prescribed medication that has been previously pulled into the main conduit 620 is discharged into the vial 300. The valve elements can be arranged so that the plungers can be retracted one at a time with only one valve element associated with the main bodies 665, 671 being open or the plungers can be operated at the same time.

It will be appreciated that the fluid transfer device 580 may need to make several aspirations and discharges of the medication into the vial 300 in order to inject the complete prescribed medication dosage into the vial 300. In other words, the cannula unit 590 can operate to first aspirate a prescribed amount of fluid into the main conduit 620 and then is operated so that it rotates over to and above one syringe 10 on the rotary dial 130, where one incremental dose amount is discharged into the vial 300. After the first incremental dose amount is completely discharged into the syringe 10, the vertical base section 582 is rotated so that the cannula unit 590 is brought back the fluid transfer position where the fluid transfer device 582 is operated so that a second incremental dose amount is aspirated into the main conduit 620 in the manner described in detail hereinbefore. The vertical base section 582 is then rotated again so that the cannula unit 590 is brought back to the rotary dial 130 above the syringe 10 that contains the first incremental dose amount of medication. The cannula 520 is then lowered so that the cannula tip is placed within the interior of the syringe 10 and the cannula unit 590 (drivers 640) is operated so that the second incremental dose amount is discharged into the syringe 10. The process is repeated until the complete medication dose is transferred into the syringe 10.

Once the syringe 10 receives the complete prescribed medication dose, the vial 300 that is positioned at the fluid transfer position can either be (1) discarded or (2) it can be delivered to a holding station 700 where it is cataloged and held for additional future use. More specifically, the holding station 700 serves as a parking location where a vial that is not completely used can be used later in the preparation of a downstream syringe 10. In other words, the vials 60 that are stored at the holding station 700 are labeled as multi-use medications that can be reused. These multi-use vials 60 are fully reconstituted so that at the time of the next use, the medication is only aspirated from the vials 60 as opposed to having to first inject diluent to reconstitute the medication.

A typical aspiration application involving an interface between the cannula 520 and the transfer device 400 is shown in FIGS. 5, 8 and 9. The drug vial 300 is provided and the transfer device 400 is pressed through the septum 320 (e.g., pierced through the recessed portion 324) of the drug vial 300 while the drug vial 300 is in an upright position. Base section 210 seats against the top surface 122 of the septum 120 when the transfer device 200 is placed in its normal intended operating position. In this example, the distal end 524 of the cannula 520 is in the form of the male luer slip fitting 490 and the connector 430 of the transfer device includes the complementary female luer slip fitting 480. The male luer slip fitting 490 and the female luer slip fitting 480 are aligned and then are brought together so that the two sealingly mate with one another, e.g., the male fitting 490 is sealingly received within the female fitting 480. The cannula unit 500 is operated so that fluid is delivered from the source 650 to the distal end 524 where it travels through the male luer slip fitting 490 and then into the mated female luer slip fitting 480 associated with the transfer device 400. The fluid flows within the connector 430 and then into the first channel 426 and then ultimately flows into the interior of the vial body. The delivery of the fluid into the vial body through the fluid portal (first channel 426) occurs while the vial 300 is erect and is in the upright position. Air displaced by the incoming fluid is expelled out of the second channel 428 and any drug particulates are captured by the filter 470. It will be appreciated that the fluid can alternatively be delivered to the transfer device 400 with a tube 600 that is connected to a source 620 of the fluid. As shown in FIG. 5, the transfer device 400 is therefore adapted to sealingly mate with the tube 600 that is operatively connected to a pump 520 which pumps a fluid from the source 620 through the tube 600 in a controlled manner. In either case, fluid is controllably delivered in a prescribed dosage amount to the transfer device 400. After the drug has been reconstituted or diluted, the next step is to remove a prescribed dosage amount from the drug vial 300.

To aspirate or withdraw the fluid, the drug vial 300 is inverted and the fluid is withdrawn through the fluid portal (first channel 426) as shown in FIG. 9. For example, in a non-automated application, occurs by mating the male luer fitting 490 of a completely closed syringe 10 to the female luer fitting 480 associated with the connector 430 of the transfer device 400. The drug vial 300 is then inverted and the fluid is withdrawn from the vial 300. Since the vial 300 is now inverted, fluid comes out of the fluid portal (first channel 426) into the syringe 10 and air is sucked into the drug vial 300 through the filter 470 and the air channel (second channel 428) into the drug vial 300 to displace the removed fluid. Since the vial 300 is inverted and air is lighter than water, the air bubbles up to the space above the fluid meniscus, while the heavier fluid moves to the septum 320 to be removed through the fluid channel 426.

Alternatively, if the syringe 10 is of the type that contains plunger 50 then the fluid can be withdrawn through the fluid portal by manipulating the syringe 10 such as by extending the plunger 50 thereof. This creates a negative pressure situation and the drug within the vial 300 is withdrawn through the fluid portal (first channel 426) while air is vented into the drug vial as described above. It will be understood that the syringe 10 can be part of an automated system and therefore, the plunger 50 can be extending using an automated process as opposed to an individual being the one that extends the plunger 50. The automated system is preferably designed so that the master controller calculates and instructs the precise distance that the plunger needs to be extended into order to draw the prescribed dosage amount into the syringe 10.

Figure 7:
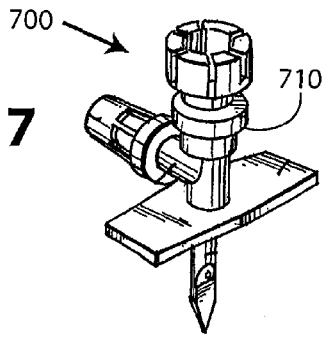
FIG. 7 is a perspective view of a fluid transfer device according to a third embodiment.

Now referring to FIG. 7 in which yet another embodiment is shown. In this embodiment, a fluid transfer device 700 is provided and is similar to the transfer device 400 in that it is of a luer fitting type; however, the fluid transfer device 700 includes a activation valve 710 that is associated with the fluid portal 426 (first channel of FIG. 5) and is constructed so that it prevents fluid from flowing in either direction through the female luer fitting. Fluid is permitted to flow through the fluid portal 426 only when the "activated" by the presence of a male luer fitting. In other words, when the male luer fitting is disposed within the female luer fitting, the male luer fitting part triggers the valve 710 and permits fluid to flow therethough in either direction. This permits the drug vial to be inverted without having to worry about the fluid flowing from the valve and out of the transfer device in the inverted position. A device similar or identical to device 700 is commercially available from B. Braun Medical Inc. as a dispending pin with a SAFESITE valve.

It will be appreciated that the present automated system provides an efficient automated system that provides effective medication preparation including the automated process of delivering a dose unit of medication to a syringe and one which overcomes the deficiencies of the prior art that were associated with weakening drug vial septums due to the repetitive interaction between a piercing object, such as a cannula, and the septum.

It will be appreciated by persons skilled in the art that the present invention is not limited to the embodiments described thus far with reference to the accompanying drawings; rather the present invention is limited only by the following claims

What is claimed is:

1. An automated medication preparation system including automated syringe preparation including reconstitution of the medication and delivery of the reconstituted medication to a syringe, the system comprising:

an automated device for delivering a prescribed dosage amount of medication from a drug vial to the syringe by injecting the medication through an uncapped barrel in a just-in-time for use manner, wherein the automated device for delivering a prescribed dosage amount of medication to the syringe comprises an automated device having a fluid delivery device that is movable in at least one direction, wherein the fluid delivery device is adapted to perform at least one of the following operations: (1) receiving and discharging diluent from a diluent supply in a prescribed amount to reconstitute the medication in the drug vial; and (2) aspirating and later discharging reconstituted medication from the drug vial into the syringe; and a transfer device that includes a first section for piercing the septum of the drug vial and a second section for sealingly yet releasably mating with the fluid delivery device, the transfer device being constructed so that it remains within the drug vial for multiple uses without the need to pierce the septum more than one time, the transfer device having a first channel extending through the first and second sections for carrying diluent or reconstituted medication and a second channel that is in fluid communication with a vent that is formed as part of the transfer device to permit air to flow into the drug vial.

2. The automated system of claim 1, wherein the fluid delivery device is fluidly connected to a main conduit that is selectively connected at its opposite end to the diluent source and to a means for creating either negative pressure or positive within the main conduit for aspirating fluid into the main conduit or discharging fluid therefrom, respectively.

3. The automated system of claim 2, wherein the means comprises:

a collection member for storing diluent received from either the diluent source or diluent that is drawn into the collection member from a downstream section of the main conduit; and a control unit and a valve mechanism that are operatively connected to the collection member to create negative pressure therein to drawn fluid therein or to create positive pressure to force fluid to be discharged therefrom.

4. The automated system of claim 3, wherein the collection member comprises:

a first syringe having a barrel with an interior having a first volume; and a second syringe having a barrel with an interior having a second volume;

wherein each of the first and second syringes having a slideable plunger contained in the respective barrel and each syringe being in selective fluid communication with each of the diluent source and the main conduit that leads to the fluid delivery device.

5. The automated system of claim 4, wherein the first volume is at least 50% greater than the second volume.

6. The automated system of claim 4, wherein the control unit comprises:

a first syringe driver associated with the first syringe for selectively moving the plunger a prescribed distance;

a second syringe driver associated with the second syringe for selectively moving the plunger a prescribed distance; and the valve mechanism includes a first valve for providing selective fluid communication between the control unit and the diluent source and a second valve for providing selective fluid communication between the control unit and the downstream section of the main conduit.

7. The automated system of claim 6, wherein the first and second syringes are fluidly interconnected by a connector conduit that has a valve associated therewith for permitting selective flow between the syringes.

8. The automated system of claim 6, wherein at least one of the first and second syringes has an input port and an output port with the input port being connected to a first conduit that connects at its opposite end to the diluent source with a valve being associated with the first conduit to provide selective communication between the diluent source and the input port, the output port being connected to a second conduit that connects at its opposite end to the main conduit with a valve being associated with the second conduit to provide selective communication between the output port and the main conduit.

9. The automated system of claim 6, wherein each of the first and second syringe drivers comprises a stepper motor that operates such that an incremental distance of movement of the plunger is equated to a number of steps through which the motor is driven, thereby permitting precise control over the exact distance that the plunger is moved.

10. The automated system of claim 1, wherein the first section comprises an end section of the transfer device that terminates in a sharp end for piercing the septum, the first section having both the first and second channels formed therein with each channel being open at the sharp end that is disposed within an interior of the drug vial after the transfer device pierces the septum and is placed in an operating position.

11. The automated system of claim 1, wherein the second section is a connector that includes one of a female luer fitting or a male luer fitting that seals with a complementary fitting formed as part of the fluid delivery device.

12. The automated system of claim 11, wherein the second section includes a female luer slip fitting and the complementary fitting comprises a male luer slip fitting.

13. The automated system of claim 11, wherein the second section includes a female luer lock fitting and the complementary fitting comprises a male luer lock fitting.

14. The automated system of claim 11, wherein the second section includes a male luer slip fitting and the complementary fitting comprises a female luer slip fitting.

15. The automated system of claim 1, wherein the vent includes (1) a hollow vent body that is integrally attached to and extends outwardly from a main body of the transfer device that includes the first section at one end and the second section at the other end, and (2) a removable cap that is slidingly received about the vent body, the cap having a filter disposed across a partially open end thereof.

16. The automated system of claim 15, wherein part of the second channel is defined by the vent body, while another part thereof is formed in the main body of the transfer device.

17. The automated system of claim 15, wherein the vent body is formed substantially perpendicular to the main body.

18. The automated system of claim 1, wherein the transfer device has a base section with the first section extending outwardly from a first face thereof and the second section extends outwardly from an opposite second face thereof, the base section having openings formed therethrough that are associated with the first and second channels.

19. An automated medication preparation system including automated syringe preparation including reconstitution of the medication and delivery of the reconstituted medication to a syringe from a drug vial, the system comprising:

an automated device for delivering a prescribed dosage amount of medication to the syringe by injecting the medication through an uncapped barrel in a just-in-time for use manner, wherein the automated device for delivering a prescribed dosage amount of medication to the syringe comprises an automated device having a fluid delivery device that is movable in at least one direction, wherein the fluid delivery device includes a fluid conduit having a first luer fitting formed at a distal end thereof; and a transfer device that includes a first section for piercing the septum of the drug vial and a second section that includes a second luer fitting that complementarily mates with the first fitting to produce a sealed luer fitting, the transfer device intended to remain within the drug vial for multiple fluid transfers without the need to pierce the septum more than one time, the transfer device having a fluid portal through which fluid can flow from the fluid delivery device to the drug vial and a vent channel that is in fluid communication with a vent that is formed as part of the transfer device to permit air to flow into the drug vial.

20. The automated system of claim 19, wherein the first luer fitting is a male luer fitting and the second luer fitting is a female luer fitting.

21. The automated system of claim 19, wherein the first luer fitting is a male slip luer fitting and the second luer fitting is a female luer slip fitting.

22. The automated system of claim 19, wherein the second section includes a female luer lock fitting and the complementary fitting comprises a male luer lock fitting.

23. The automated system of claim 19, wherein the vent includes (1) a hollow vent body that is integrally attached to and extends outwardly from a main body of the transfer device that includes the first section at one end and the second section at the other end, and (2) a removable cap that is slidingly received about the vent body, the cap having a filter disposed across a partially open end thereof.

24. An automated medication preparation system including automated syringe preparation including reconstitution of the medication and delivery of the reconstituted medication to a syringe from a drug vial, the system comprising:

an automated device for delivering a prescribed dosage amount of medication to the syringe by injecting the medication through an uncapped barrel in a just-in-time for use manner, wherein the automated device for delivering a prescribed dosage amount of medication to the syringe comprises an automated device having a fluid delivery device that is movable in at least one direction and includes a main fluid conduit; and a vented dispensing pin that includes a first section for piercing the septum of the drug vial and a second section that along with a coupling feature of the fluid transfer device forms a male-female interference fitting that creates a continuous fluid pathway by joining the fluid delivery device and the transfer device includes a second luer fitting that complementarily mates with the first luer fitting to produce a sealed luer fitting, the transfer device intended to remain within the drug vial for multiple fluid transfers without the need to pierce the septum more than one time, the transfer device having a fluid portal through which fluid can flow from the fluid delivery device to the drug vial and a vent channel that is in fluid communication with a vent that is formed as part of the transfer device to permit air to flow into the drug vial.

25. The automated system of claim 24, wherein the first section is formed by removing a wedge shaped section of the distal end of main fluid conduit to form a sharp, pointed end.

26. The automated system of claim 24, wherein the transfer device has an activation valve associated with the fluid portal for selectively preventing fluid from flowing within the fluid portal in either direction except when the valve has been activated.

27. The automated system of claim 26, wherein the second luer fitting comprises a female luer and the first luer fitting comprises a male luer and the valve is activated by the presence of the male luer fitting within the female luer fitting.

28. The automated system of claim 24, wherein medication is removed from the drug vial through the fluid portal while the drug vial is in an inverted position and as the medication is removed, air is drawn through a vent filter and through the vent channel into the drug vial to displace the removed medication.

* * * * *

UNITED STATES PATENT AND TRADEMARK OFFICE

CERTIFICATE OF CORRECTION

PATENT NO. : 7,128,105 B2
APPLICATION NO. : 10/821268
DATED : October 31, 2006
INVENTOR(S) : Dennis Tribble et al.

It is certified that error appears in the above-identified patent and that said Letters Patent is hereby corrected as shown below:

On Title Page item 75

In the Inventor's name:

Please delete "Wahid Khan, Lindenhurst, IL (US)" and substitute with

-- Abdul Wahid Khan, Lindenhurst, IL (US) --.

Signed and Sealed this

Twelfth Day of June, 2007

JON W. DUDAS
*Director of the United States Patent and Trademark Office*